US006238034B1

(12) United States Patent
Ono

(10) Patent No.: US 6,238,034 B1
(45) Date of Patent: May 29, 2001

(54) INK-JET RECORDING METHODS AND APPARATUSES

(75) Inventor: Takeshi Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/948,519

(22) Filed: Oct. 10, 1997

Related U.S. Application Data

(63) Continuation of application No. 08/625,009, filed on Mar. 29, 1996, now abandoned, which is a continuation of application No. 08/081,709, filed on Jun. 25, 1993, now abandoned.

(30) Foreign Application Priority Data

Jun. 26, 1992 (JP) ..... 4-169522

(51) Int. Cl.[7] ..... B41J 2/01
(52) U.S. Cl. ..... 347/9; 347/14; 347/15
(58) Field of Search ..... 347/9–11, 14, 347/19, 15, 40, 37; 395/112; 358/1, 13

(56) References Cited

U.S. PATENT DOCUMENTS

| | | | | |
|---|---|---|---|---|
| 4,087,825 | | 5/1978 | Chen et al. | 346/75 |
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,561,025 | | 12/1985 | Tsuzuki | 358/298 |
| 4,566,813 | * | 1/1986 | Kobayashi et al. | 346/76 PH X |
| 4,710,784 | | 12/1987 | Nakayama | 346/140 R |
| 4,723,129 | | 2/1988 | Endo et al. | 346/1.1 |
| 4,740,796 | | 4/1988 | Endo et al. | 346/1.1 |
| 4,774,528 | * | 9/1988 | Kato | 346/76 PH |
| 5,017,948 | * | 5/1991 | Koizumi et al. | 347/14 |
| 5,155,503 | | 10/1992 | Tasaki et al. | 346/140 R |
| 5,202,769 | * | 4/1993 | Suzuki | 358/300 |
| 5,680,521 | * | 10/1997 | Pardo et al. | 395/112 |

FOREIGN PATENT DOCUMENTS

| | | | | |
|---|---|---|---|---|
| 156360 | * | 2/1985 | (EP) . | |
| 0288044 | | 10/1988 | (EP) . | |
| 0317140 | | 5/1989 | (EP) . | |
| 315206 | * | 5/1989 | (EP) | 347/9 |
| 2112980 | | 7/1983 | (GB) . | |
| 11067 | * | 1/1982 | (JP) . | |
| 57-96877 | | 6/1982 | (JP) . | |
| 160666 | * | 10/1982 | (JP) . | |
| 59-28758 | | 2/1984 | (JP) . | |
| 59-123670 | | 7/1984 | (JP) . | |
| 59-138461 | | 8/1984 | (JP) . | |
| 23063 | * | 2/1985 | (JP) | 346/76 PH |
| 61-8360 | | 1/1986 | (JP) . | |
| 49460 | * | 3/1988 | (JP) | 346/76 PH |
| 95964 | * | 4/1988 | (JP) | 346/76 PH |
| 2-190354 | | 7/1990 | (JP) . | |
| 361553 | | 3/1991 | (JP) . | |
| 78537 | * | 3/1992 | (JP) | 347/9 |
| 9204191 | | 3/1992 | (WO) . | |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

An ink-jet recording apparatus includes recording head having a plurality of recording elements and performs image recording by the steps of detecting a presence of black dots in a prescribed amount of input data and calculates a percentage of black dots, selecting a suitable recording mode for forming an image of the prescribed amount of input data on the recording medium in response to a result of the calculation, and controlling a drive condition of the recording head in accordance with the selected mode. When the percentage of the black dots exceeds a prescribed level, the recording head is driven so as to remove some dots from a total number of dots corresponding to the prescribed amount of the input data or reducing thermal energy to be supplied to the thermal elements in the cause of the image recording.

16 Claims, 8 Drawing Sheets

INK-JET RECORDING METHODS AND APPARATUSES

This application is a continuation of application Ser. No. 08/625,009, filed Mar. 29, 1996, which was a continuation of Application Ser. No. 08/081,709, filed Jun. 25, 1993, both now abandoned.

BACKGROUND OF THE INVENTION

1. Field of the Invention

The present invention relates to ink-jet recording methods and apparatuses used for forming images of input data such as characters, pictures, drawings or the like on a recording medium.

2. Related Background Art

Recently, the ink-jet recording method has been increasingly attracting attention in the field of a data processing, and it comprises the step of forming an image of input data of characters, pictures, drawings or the like on a recording medium (e.g. a sheet of paper, an OHP sheet or a sheet of cloth) by directly ejecting ink droplets from minute nozzles. Therefore, ink-jet recording apparatuses including recording means for performing such method have been used in data processing systems: they have been provided as printers as output terminals of copying machines, facsimiles, printing machines, word processors, work stations, or the like; or they have been provided as handy- or portable-printers of personal computers, host computers, optical disc- or video-equipment or the like.

The recording means (e.g., a recording head) comprises a plurality of recording elements which are arranged in a direction perpendicular to a scanning direction of the recording means. Each recording element has a liquid passage with a recording element (e.g., a thermal element). The liquid passage communicates to a minute nozzle (e.g., an ink ejection outlet) through which ink droplets can be successively ejected to a surface of the recording medium in response to a command corresponding to the input data. The recording element is provided in the liquid passage to generate thermal energy to cause sudden volume change of the ink around the recording element. Consequently an ink droplet is pushed out from the minute nozzle.

In the conventional ink-jet recording apparatus, a certain amount of input data corresponding to one page of the information to be recorded as an image is referred as image data which is divided into several blocks, i.e., the block is an aliquot part of the image data enough to form one line of the page by one scanning movement of the recording head. In this specification, the scanning movement of the recording head is defined as a movement of the recording head for printing one block of the image data so as to form a line of the page in a direction perpendicular to a transporting direction of the recording medium. In this specification, furthermore, the transporting direction of the recording medium is referred as a sub-scanning direction while the direction perpendicular to the transporting direction is referred as a main-scanning direction. Therefore the recording head prints one block of the image data to form one line of the page on the recording medium by performing one scanning movement thereof. By repeating the scanning movements of the recording head, the data corresponding to one page of the information can be recorded on the recording medium. After preparing one block of the image data for the one scanning movement, the recording head starts the scanning movement at a constant speed. During the recording, a plurality of dots is successively putted on a surface of the recording medium by ejecting ink droplets from the recording head. Therefore the block can be defined as a unit of the image data for recording by one scanning movement of the recording head. In general, a size of the block is limited by a capacitive condition of the image memory at a time of directly before the scanning movement, or it is limited by other factors such as the amount of dots to be formed by the recording head of a semimulti-type, a size of the recording medium, a moved distance of the carriage from a starting point, or the like.

In this type of the ink-jet recording apparatus, the recording elements are driven all at once, or block by block consisting of a certain number of the recording elements by applying voltage pulses of a certain width in sequence. In general, it is important to control the pulse width so that each pulse gives just sufficient energy for ejecting ink so that excess energy is not produced. This is important not only for energy saving but also for stabilizing the ink ejection in the course of repetitive drive of the recording head.

In this type of the ink-jet recording apparatus, furthermore, there are two printing modes: a normal mode for directly recording input data just as it is; and a draft mode for recording input data after performing a thinned-out processing in which some dots are removed in accordance with a certain rule or with a certain period for the purpose of: saving the ink; shortening a printing period; or performing a high-speed printing. According to such thinned-out processing, for example, adjacent dots are not printed at the same time so as to a checkered pattern is formed. These modes can be selected by setting the bit switch at a time of switching the electric power on, or they can be selected by operating the key on the operation panel at intervals of forming images corresponding to respective pages of the recording medium.

In spite of the above advantageous features of the conventional ink-jet recording apparatus, however, the conventional recording apparatus cannot select such modes at intervals of forming parts of an image corresponding to respective lines of the page. Therefore a large amount of ink is ejected in spite of that an image of the block having a lot of black dots should be formed, and resulting that a surface of the recording medium becomes wet with the ink and wrinkles easily. In the case of that the draft mode is selected at all times, on the other hand, a small amount of ink is ejected in spite of that an image of the block having a few black dots should be formed, and resulting that an obtained image is hard to read because the characters are blurred.

Furthermore, the conventional ink-jet recording apparatus does not have any means for controlling potencies of the energies used for ejecting ink droplets during a process of recording one block of the image data. Consequently, the recording head can be gradually over heated and a viscosity of the ink to be ejected from the orifices can be gradually decreased when a percentage of the black dots in one block or the prescribed amount of the image data for the one scanning movement of the recording head is comparatively at a higher level (over 50%) during the one block recording. Therefore a volume of the ink droplet tends to rise during the printing and the quality of recorded images can be deteriorated.

SUMMARY OF THE INVENTION

It is therefore an object of the present invention, in view of the above problems, to provide an improved recording method and apparatus. It is another object of the present invention to provide a recording method and apparatus that can achieve high quality recorded images by making it possible to perform optimum control of the (recording) element drive.

In a first aspect of the present invention, there is provided an ink-jet recording apparatus for recording an image on a recording medium by using a recording means which ejects ink in accordance with image data, comprising:

detecting means for detecting a percentage of black dots in a predetermined amount of the image data; and control means for determining a recording mode of the predetermined amount of the image data in accordance with a result of the detection in the detecting means.

Here, the amount of energy to be supplied to a recording element used for ejecting the ink may be reduced step by step under a control of the controlling means in accordance with a first recording mode in the course of recording the amount of the image data when the percentage of the black dots exceeds a predetermined value, preferably exceeds 50%.

The amount of energy to be supplied to a recording element used for ejecting the ink may be maintained at a constant under a control of the controlling means in accordance with a second recording mode in the course of recording the amount of the image data when a percentage of the black dots is under a predetermined value, preferably under 50%.

A recording apparatus may further comprise:

drive means for perform a relative movement of the recording means against the recording medium for recording the predetermined amount of the image data, and the control means reduces the energy step by step in the course of the relative movement of the recording means in accordance with the first recording mode.

A recording apparatus may further comprise:

drive means for perform a relative movement of the recording means against the recording medium for recording the predetermined amount of the image data, and the control means maintains the amount of the energy at a constant in the course of the relative movement of the recording means in accordance with the second recording mode.

The recording means may have a popularity of the recording elements, and the recording means travels along a direction differed from an arrangement direction of the plurality of recording elements to perform a scanning movement for recording the predetermined amount of the image data.

The predetermined amount of the image data may be equivalent to the amount of data enough to fill a region to be recorded by one scanning movement of the recording means.

The recording means may eject an ink droplet by causing conditional change of ink by using thermal energy.

In a second aspect of the present invention, there is provided an ink-jet recording apparatus for recording an image on a recording medium by using a recording means which ejects ink in accordance with image data, comprising:

detecting means for detecting a percentage of black dots in a predetermined amount of the image data; and control means for determining a recording mode of the predetermined amount of the image data in accordance with a result of the detection in the detecting means, the recording mode determines the number of the black dots in the predetermined amount of the image data.

Here, the recording means may be driven by the control means so as to remove some dots from a total number of dots corresponding to the predetermined amount of the image data when the percentage of the black dots exceeds a predetermined value, preferably exceeds 50%.

The recording means may be driven by the control means so as to record a whole dots corresponding to the predetermined amount of the image data when the percentage of the black dots is under a predetermined value, preferably under 50%.

A recording apparatus may further comprise:

drive means for performing a relative movement of the recording means against the recording medium for recording the predetermined amount of the image data, and the control means determines the recording mode in accordance with the percentage of the black dots before the relative movement of the recording means.

The recording means may have a plurality of the recording elements, and the recording means travels along a direction differed from an arrangement direction of the plurality of recording elements to perform a scanning movement for recording the predetermined amount of the image data.

The predetermined amount of the image data may be in a correspondence with the amount of image data to be formed as an image by one scanning movement of the recording head.

The controlling means may determine the recording mode at intervals of performing the scanning movements.

The recording means may eject an ink droplet by causing conditional change of ink by using thermal energy.

In a third aspect of the present invention, ther is provided an ink-jet recording method for recording image on a recording medium by using a recording means in accordance with image data, comprising the steps of:

detecting a percentage of black dots in a predetermined amount of the image data (step 1);

selecting a recording mode of the predetermined amount of the image data in accordance with the percentage of the black dots detected in the step 1 (step 2); and recording the predetermined amount of the image data in accordance with the recording mode predetermined in the step 2 (step 3).

Here, a first mode may be selected in the step 2 to reduce the amount of energy to be supplied to a recording element used for ejecting the ink in the course of recording the amount of the image data when a percentage of the black dots exceeds a predetermined value, preferably exceeds 50%.

A second mode may be selected the step 2 to maintain a constant amount of energy to be supplied to a recording element used for ejecting the ink in the course of recording the amount of the image data when a percentage of the black dots is under a predetermined value, preferably under 50%.

A relative movement of the recording means against the recording medium for recording the predetermined amount of the image data may be performed in the step 3, and the energy is reduced step by step in the course of the relative movement of the recording means in accordance with the first recording mode.

A relative movement of the recording means against the recording medium for recording the predetermined amount of the image data may be performed in the step 3, and the energy is maintained at a constant level in the course of the relative movement of the recording means in accordance with the second recording mode.

The recording means may have a plurality of the recording elements, and the drive means moves the recording means along a direction differed from an arrangement direction of the plurality of recording elements in the step 3 to perform a scanning movement for recording the predetermined amount of the image data.

The predetermined amount of the image data may be equivalent to the amount of data enough to fill a region to be recorded by one scanning movement of the recording means.

The recording means may eject an ink droplet by causing conditional change of ink by using thermal energy.

In a fourth aspect of the present invention, there is provided an ink-jet recording method for recording image on a recording medium by using a recording means in accordance with image data, comprising the steps of:

detecting a percentage of black dots in a predetermined amount of the image data (step 1);

selecting a recording mode of the predetermined amount of the image data in accordance with the percentage of the black dots detected in the step 1 (step 2); and recording the predetermined amount of the image data in accordance with the recording mode predetermined in the step 2 for determining the number of the black dots in the predetermined amount of the image data (step 3).

Here, a second mode may be selected in step 2 to perform the recording so as to remove some dots from a total number of dots corresponding to the predetermined amount of the image data when the percentage of the black dots exceeds a predetermined value, preferably exceeds 50%.

A normal mode may be selected in the step 2 to perform the recording so as to maintain a total number of dots corresponding to the predetermined amount of the image data when the percentage of the black dots is under a predetermined value, preferably under 50% in the step 2.

The predetermined amount of the image data may be recorded by performing a relative movement of the recording means against the recording medium in the step 3, and the recording mode may be predetermined in the step 2 in accordance with the percentage of the black dots before performing the relative movement of the recording means.

The recording means may have a plurality of the recording elements, and in step 3 the recording means moves along a direction differed from an arrangement direction of the plurality of recording elements to perform a scanning movement for recording the predetermined amount of the image data.

The predetermined amount of the image data may be in a correspondence with the amount of image data to be formed as an image by one scanning movement of the recording head.

The step 2 may be performed at intervals of performing the scanning movements to select appropriate recording mode for each scanning movement.

The recording means may eject an ink droplet by causing conditional change of ink by using thermal energy.

The above and other objects, effects features and advantages of the present invention will become more apparent from the following description of embodiments thereof taken in conjunction with the accompanying drawings.

BRIEF DESCRIPTION OF THE DRAWINGS

Embodiments of the invention will now be described, by way of example, and with reference to the accompanying drawings in which.

DESCRIPTION OF THE PREFERRED EMBODIMENTS

Figure 1:
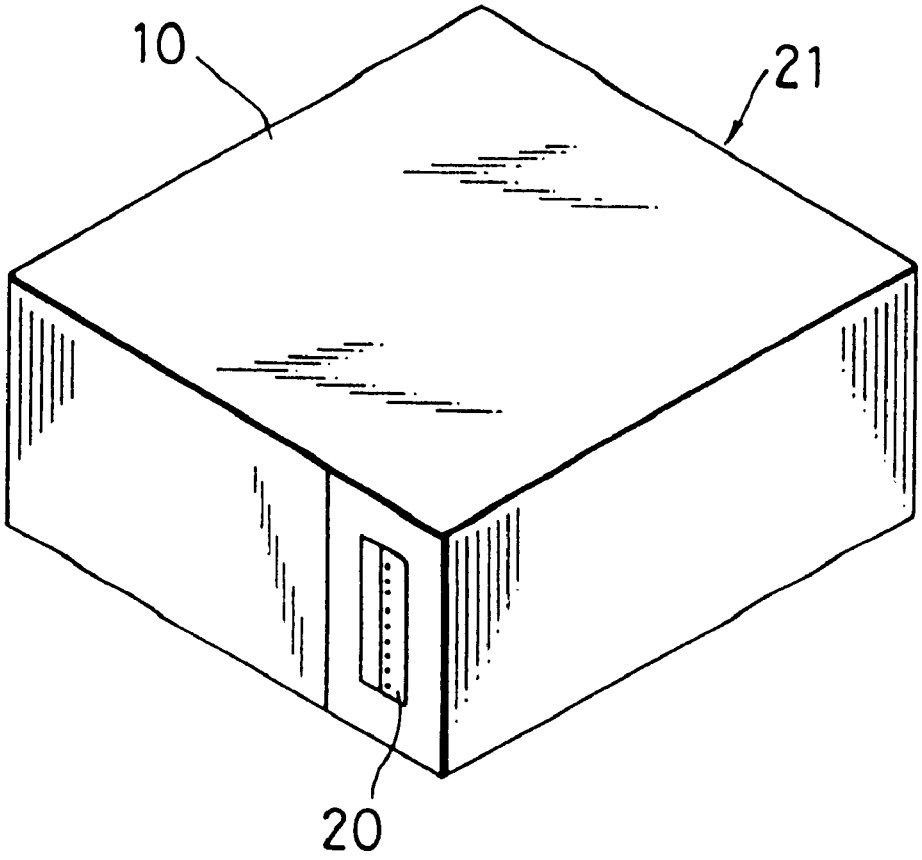
FIG. 1 is a schematic perspective view showing an example of an ink-jet cartridge used by an ink-jet recording apparatus in accordance with the present invention.
Figure 2:
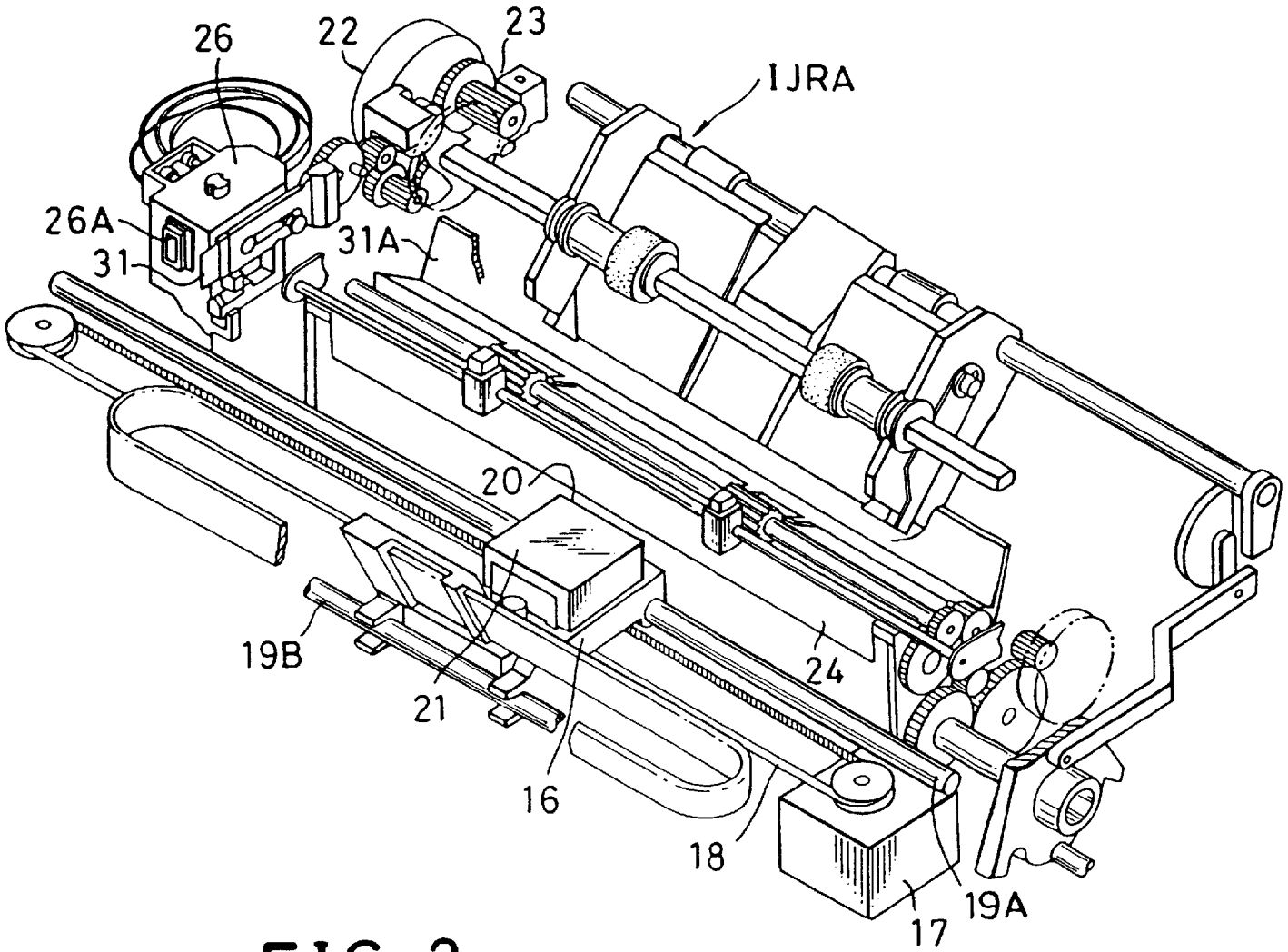
FIG. 2 is a schematic perspective view showing an ink-jet printer used by an ink-jet recording apparatus in accordance with the present invention.

Referring now to the attached drawings for a more complete understanding of the invention, FIGS. 1 and 2 show a first preferred embodiment of a novel ink-jet recording apparatus to be provided as a recording system in a facsimile in accordance with the present invention.

In these figures, reference numeral 21 designates an ink-jet cartridge. The cartridge 21 is composed of an ink-jet recording head 20 and an ink tank 10 and is formed as a disposable type one which can be removably secured to a carriage 16 of the ink-jet recording apparatus (IJRA).

The ink-jet recording head 20 comprises a plurality of recording elements which are arranged in a direction perpendicular to a scanning direction of the recording head 20. Each recording element has a minute nozzle, a liquid passage and a thermal element. The recording head 20 is in the type of ejecting ink droplets from each minute nozzle formed in the tip thereof to a surface of the recording medium such as a sheet of recording paper (i.e, a record sheet) by forming a bubble in the ink by applying a thermal energy generated by the thermal element. In this embodiment, the tip of the recording head 20 is slightly protruded from a surface of the cartridge 21.

The ink tank 10 is composed of an ink absorbent; a container for holding the absorbent with ink; and a cover for sealing an opening of the container (these elements are not shown in the figures). The ink tank 10 is filled with ink and supplies the ink little by little to the ink-jet recording head 20 so as to smoothly eject ink droplets from each nozzle of the head 20.

The ink jet cartridge 21 thus constructed is removably mounted on a carriage of the ink jet recording apparatus IJRA to be described later in a predetermined manner so that a desired image is recorded on a record sheet by relative movement between the carriage HC and the record sheet in accordance with an input image data.

Reference numeral 20 denotes an ink jet head (record head) of the ink jet head cartridge 21 having nozzles which eject ink to a record plane of the record sheet fed onto a platen 24 by feed means which is driven by a paper feed motor to be described later. Reference numeral 16 denotes a carriage for holding the ink jet cartridge 21.

The carriage 16 is connected with a part of a driving belt 18 for transmitting the drive force of a carriage motor 17 to the carriage 16 so that the carriage 16 moves along two guide shafts 19A and 19B. These shafts 19A and 19B are parallel provided each other to keep a stable movement of the carriage 16. Therefore the recording head 20 can be reciprocally moved in an extent of a total width of a record plane of the record sheet on a platen 24, along which the recording head 20 forms an image in accordance with the input data. At intervals of the scanning movements, the record sheet is transported step by step with a prescribed length in a direction perpendicular with the main-scanning direction.

Reference numeral 26 denotes a head recovering member being arranged on a position facing to one end of a path on which the recording head 20 can be moved forth and back in a direction perpendicular to the transporting direction (i.e., the sub-scanning direction) of the record sheet. This end of the path is defined as "a home position" of the recording head. The head recovering system 26 is driven by a driving force of a driving motor 22 via a transmission mechanism 23 and performs a capping operation. In the capping operation, the recording head 20 is stayed at the home position and is capped with a capping member 26A of the head recovering system 26.

In conjunction with the capping operation, a process of removing ink with a high viscosity or eliminating the ejection failure caused by drying or caking of ink in the liquid passages or near the nozzles of the recording head 20 is performed so as to smoothly eject ink droplets. These undesirable ink portions can be forcibly removed by sucking means such as a suction pump installed in the head recovering system 26. The recording head 20 can be protected by capping the head with the capping member 26A when the recording process is completed. These processes are carried out in the case of that an electric power source is switched on; the recording head is replaced by new one; or a non-recording state continues for a long time or particular orifices are not used for long time owing to the arrangement or printed images.

Adjacent to the head recovering system 26, a blade 31 is disposed in such a manner that it can project toward the region where the recording head 20 can move. The blade 31 is made of silicone rubber and is held by a blade holding means 31A. The blade 31 is used to wipe the orifice disposed face after performing the ejection recovery process or the like so that wet or paper particulate contaminates are removed therefrom. Such wiping motion is carried out by a force caused by the driving motor 22 and the driving mechanism 23 used for driving the recovering system 26.

Figure 3:
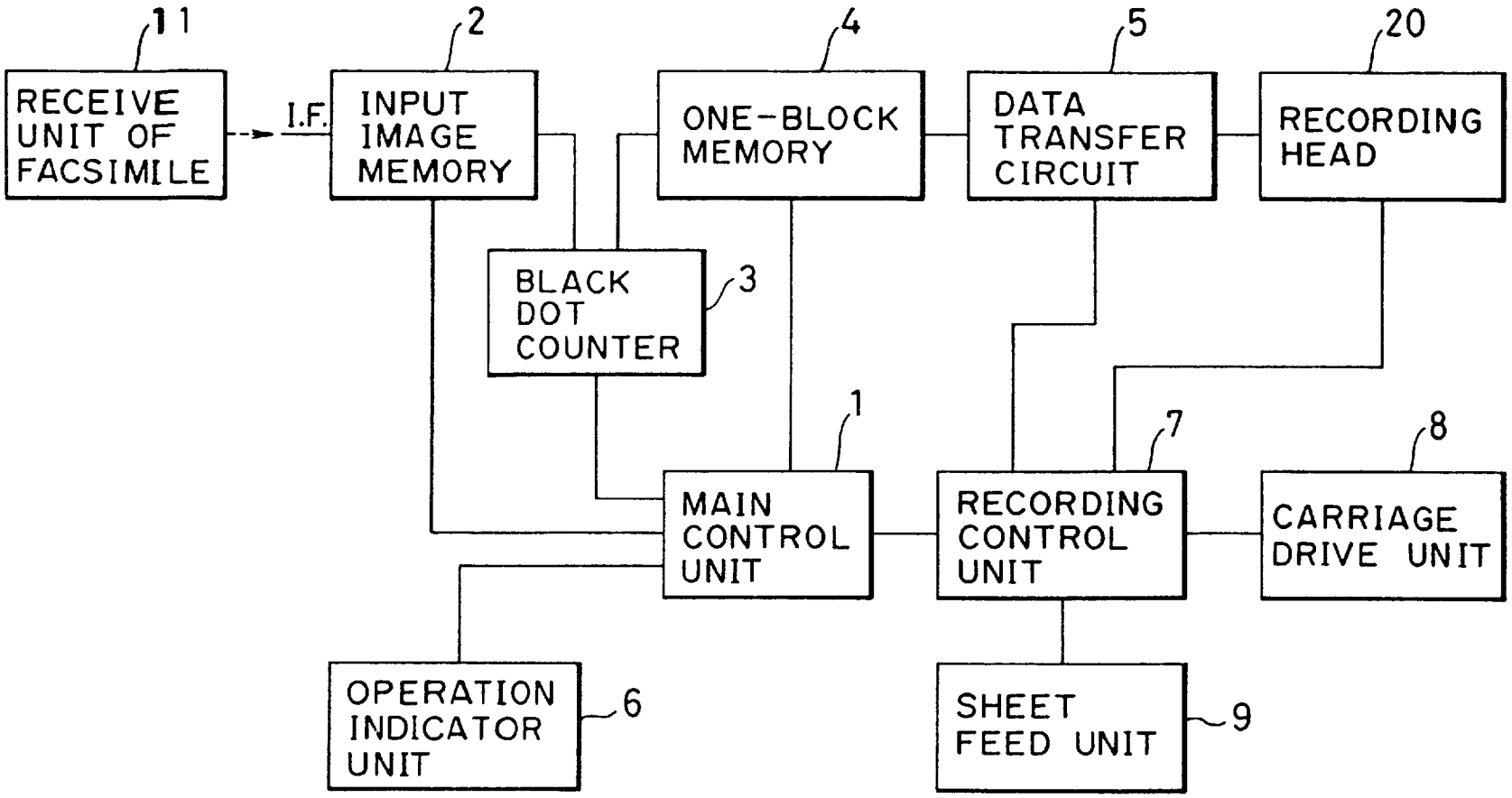
FIG. 3 is a block diagram showing the details of the ink-jet recording apparatus in accordance with the first preferred embodiment of the present invention.

FIG. 3 is a block diagram showing an arrangement of a control system of the recording apparatus of the first preferred embodiment.

Reference numeral 1 denotes a main control unit of the recording apparatus. The main control unit 1 is responsible for controlling the recording apparatus as a whole so as to perform data processing.

Reference numeral 2 denotes an input memory for accepting image data from a host apparatus functioning as the source of the image data. In this embodiment, the host apparatus is a receiving unit of the facsimile 11. The input memory 2 transfers the image data to a one-block image memory 4 while a black-dot counter 3 counts the total number of black dots in one block of the image data. The count can be also performed by a software on the CPU in the main control unit. In general, the CPU is connected to an ROM that stores various programs executed by the CPU, and also the CPU is connected to an RAM used as working areas (CPU, ROM and RAM are not shown in the figure).

In this embodiment, the ink-jet recording apparatus comprises recording head which is in the type of a semi-multi typed head having nozzles corresponding to dozens of dots and using thermal energy for ejecting ink from a minute nozzle by causing sudden volume change of the ink around the recording element (i.e, thermal element which is responsible for generating the thermal energy). The recording head records data corresponding to one page of the information on a record sheet by several scanning movements.

Reference numeral 5 denotes a data transfer circuit which is responsible for transferring the image data from the one-block image memory 4 to the recording head 20.

Reference numeral 7 denotes a recording control unit composed of one tip micro-computer. The recording control unit 7 controls a process of transferring the data from the circuit 5 to the recording head 20 and a process of driving the head 20 in accordance with the provided data. The recording control unit 7 is also connected to a carriage drive unit 8 and a recording medium transfer unit (a sheet feed unit) 9. The recording control unit 7 sends control signals to these units 8 and 9 for driving the recording head 20 with an appropriate manner. The carriage drive unit 8 is composed of a carriage motor and a motor driver, while the recording medium transferring unit 9 is composed of a feed motor and a motor driver.

Reference numeral 6 denotes an operation indicator unit having key switches, LED, LCD and the like for indicating the condition of the recording apparatus.

Reference numeral 11 denotes a receiving unit of the facsimile. This unit 11 is able to receive image data from everywhere through the lines. The received data is restored and then it is transferred to the input image memory 2 through the interface (I.F).

In this embodiment, the recording head 20 has a thermometer for measuring the temperature of an inner side of the recording head 20 for driving the thermal elements of the head with the optimum driving pulse width.

Figure 4:
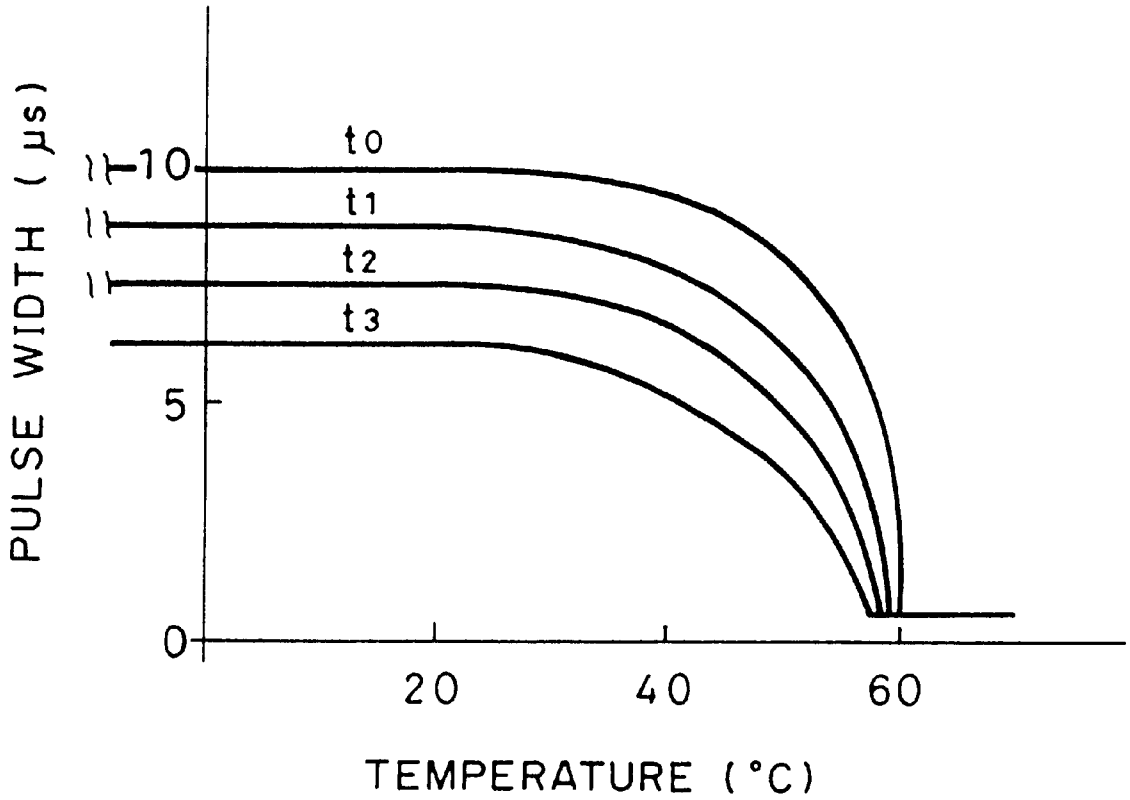
FIG. 4 is a graphical representation of the relation between the pulse width and the temperature of the recording head.

FIG. 4 indicates four different table of the voltage pulse width, which are written in the ROM. In the figure, a vertical line indicates the pulse width and a horizontal line indicates the temperature of the recording head. These different table of the pulse width ($t_0$–$t_3$) in the range of 10 to 6 $\mu$S can be selected and changed by the ROM during each scanning movement of the recording head in accordance with a different number of black dots in each block.

Figure 5:
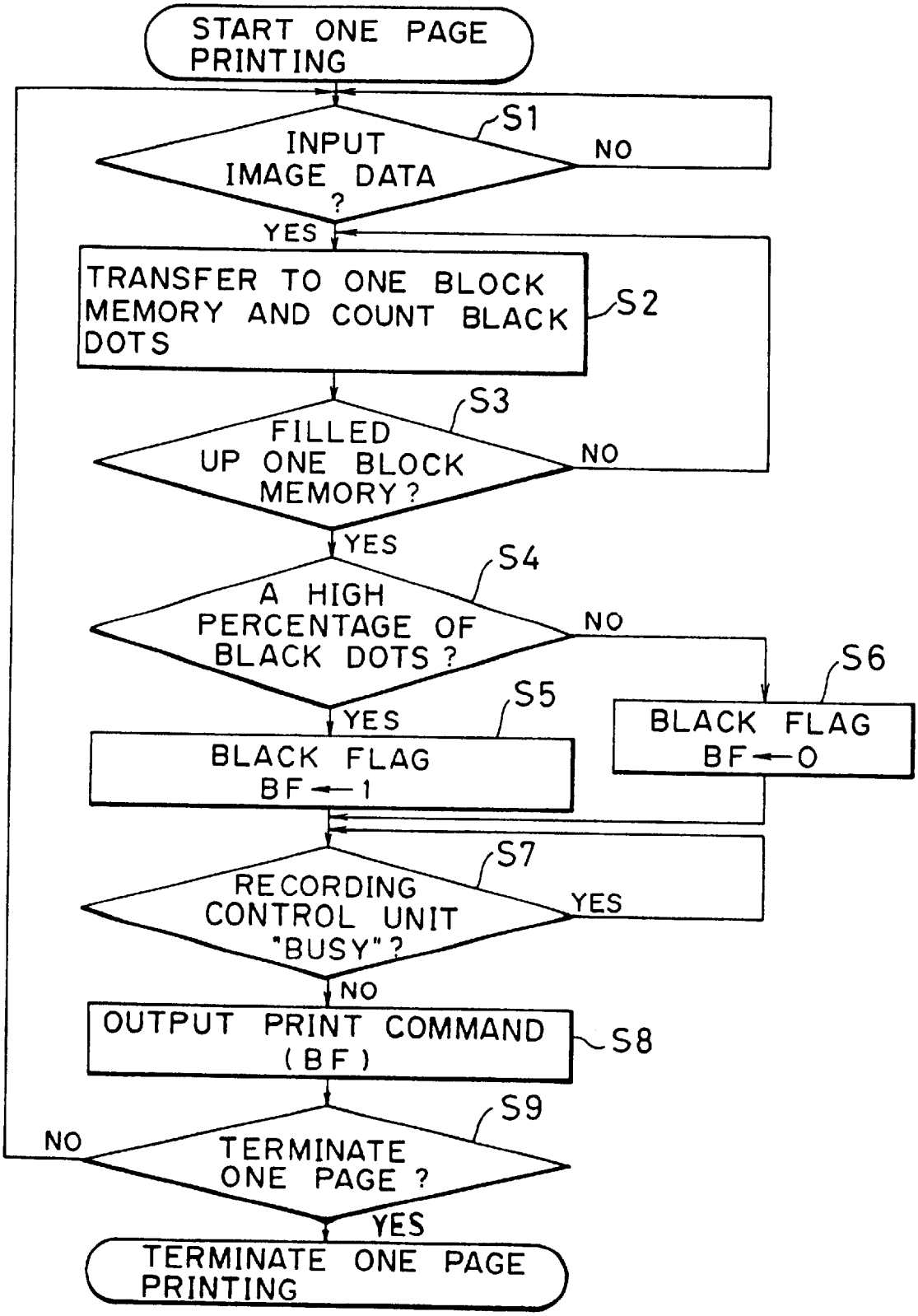
FIG. 5 is a general flow chart of a recording process controlled by the main control unit and used for forming the image of data corresponding to one page of the recording medium.

FIG. 5 is a general flow chart of a recording process controlled by the main control unit 1 and used for forming an image of data corresponding to one page of the recording medium. The recording process comprises the following steps:

(1) In step 1 (S1), judge whether image data is input from the receiving unit 11 through an interface (IF);

(2) If the input of the image data is satisfied in the decision step 1, step in the direction of step 2;

(3) If the input of the image data is not satisfied in the decision step 1, repeat the step 1;

(4) In the step 2, count the number of the black dots in the image data and at the same time transfer such data to the one block memory 4;

(5) In the step 3, judge whether the one block memory 4 is filled up with the image data;

(6) If the filling state of the one block memory is satisfied in the decision step 3, step in the direction of step 4;

(7) If the filling state of the one block memory is not satisfied in the decision step 3, repeat the step 2;

(8) In the step 4, judge whether a percentage of the black dots is higher than the predetermined level;

(9) If the percentage of the black dots is satisfied in the decision step 4, step in the direction of step 5;

(10) If the percentage of the black dots is not satisfied in the decision step 4, step in the direction of step 6.

(11) In the step 5, set a black flag (BF) to "1" and step in the direction of step 7;

(12) In the step 6, set the black flag (BF) to "zero" and step in the direction of the step 7.

(13) In the step 7, judge whether the recording control unit 7 is in a busy state.

(14) If it is in the busy state at the moment in the decision step 7, repeat the step 7;

(15) If it is not in the busy state in the decision step 7, step in the direction of step 8;

(16) In the step 8, output a print command for printing one block of the image data to the recording control unit 7 and also output a value of the BF as information to the recording control unit 7;

(17) In the step 9, judge whether the recording of the image data for one page is terminated;

(18) If it is terminated in the decision step 9, terminate the recording process; and

(19) If it is not terminated in the decision step 9, step in the direction of the step 1 and repeat the steps from 1 to 9.

In the above described process, one block of the image data is stored as dot image data which are decoded in the one block memory 4. For example such block data is in a correspondence with a memory of 1728×48 (82944) dots when a semimulti-type recording head with 45 dots in one row and with a resolution of 8 dots/mm in a main scanning direction is used for forming an A-4 sized image.

Figure 6:
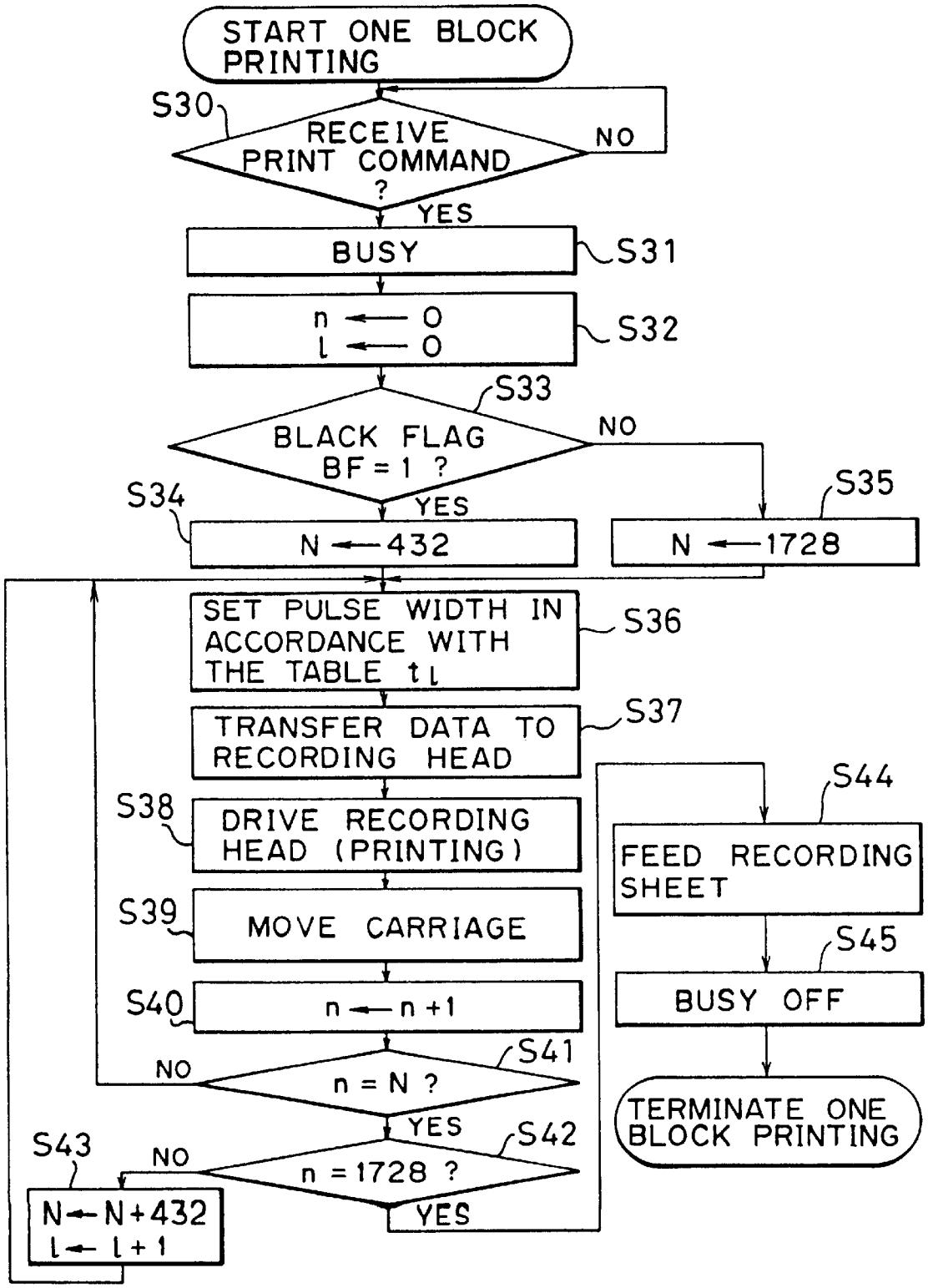
FIG. 6 is a general flow chart of a recording process controlled by the recording control unit and used for forming the image of one block of data.

FIG. 6 is a general flow chart of a recording process controlled by the recording control unit 7 for the one block recording. The recording process comprises the following steps:

(1) In step 30, judge whether the print command is received from the main control unit 1;

(2) If the print command is received in the decision step 30, step in the direction of step 31;

(3) If it is not received in the decision step 30, repeat the step 30;

(4) In the step 31, send a signal "BUSY" as a status signal to the main control unit 1 and step in the direction of step 32;

(5) In the step 32, define the values "n" and "1" of the counter as zero;

(6) In step 33, judge whether the black flag BF takes the value "1";

(7) If the black flag BF takes the value "1" (it means the high percentage of the black dots in one block of the image data) in the decision step 33, step in the direction of step 34;

(8) If the black flag does not take the value "1" in the decision step 33, step in the direction of step 35;

(9) In the step 34, insert "432" into "N" and step in the direction of step 36;

(10) In the step 35; insert "1728" into "N" and step in the direction of step 36;

(11) In the step 36, determine an appropriate pulse width for driving the thermal elements in accordance with the relation between the pulse width and the temperature of the recording head (FIG. 4), but select to (most wide) for the counter number 1=0 at first, and then step in the direction of step 37;

(12) In the step 37, transfer the image data for one row of the recording head 20 and step in the direction of step 38;

(13) In the step 38, drive the recording head 20 based on the one row of the image data and step in the direction of step 39;

(14) In the step 39, move the carriage along the scanning direction and print the one row of the image data, and then step in the direction of step 40;

(15) In the step 40, increment the value of the counter from "n" to "n+1", and then step in the direction of step 41;

(16) In the step 41, judge whether the "n" is equal to "N";

(17) If the "n" is equal to "N" in the decision step 41, step in the direction of step 42;

(18) If the "n" is not equal to "N" in the decision step 41, step in the direction of step 36 and then repeat the steps 36–41;

(19) In the step 42, judge whether the "n" takes the value "1728";

(20) If the "n" takes the value "1782", step in the direction of step 44;

(21) If the "n" does not take the value "1782", step in the direction of step 43;

(22) In the step 43, increment the value of the counter from "N" to "n+432" and "1" to "1+1", and then step in the direction of the step 36 to repeat the steps 36–42;

(23) In the step 44, move the recording medium for one block and then step in the direction of step 45;

(24) In the step 45, turn the "BUSY" off and terminate the recording process for one block of the image data.

In the case of that the black flag BF takes "0" (i.e., BF=0, a low percentage of the black dots occupied in the image) in the step 33, repeat the steps 36–41 for 1728 times (corresponding to one line of the A4 sized image data) and then step in the direction of step 42.

In the case of that the black flag takes "1" (i.e., BF=1, percentage of the black dots occupied in the image is more than 50%), repeat the steps 36–41 for 432 times to record a first quarter of the block and then step in the direction of step 41. In this embodiment, the block is divided into four quarters which are independently recorded in turn with the pulse width table $t_0$, $t_1$, $t_2$ and $t_3$, respectively. Thus the pulse width is narrowed step by step in accordance with a progression of the recording. In addition, the ink ejection volume can be gradually reduced not only by limiting the pulse width but also by controlling a voltage or current to be supplied.

A stable recording image can be obtained by controlling the pulse width of the driving voltage used for printing the one block so as to make a pattern of the ink ejection uniform during the recording process.

Figure 7:
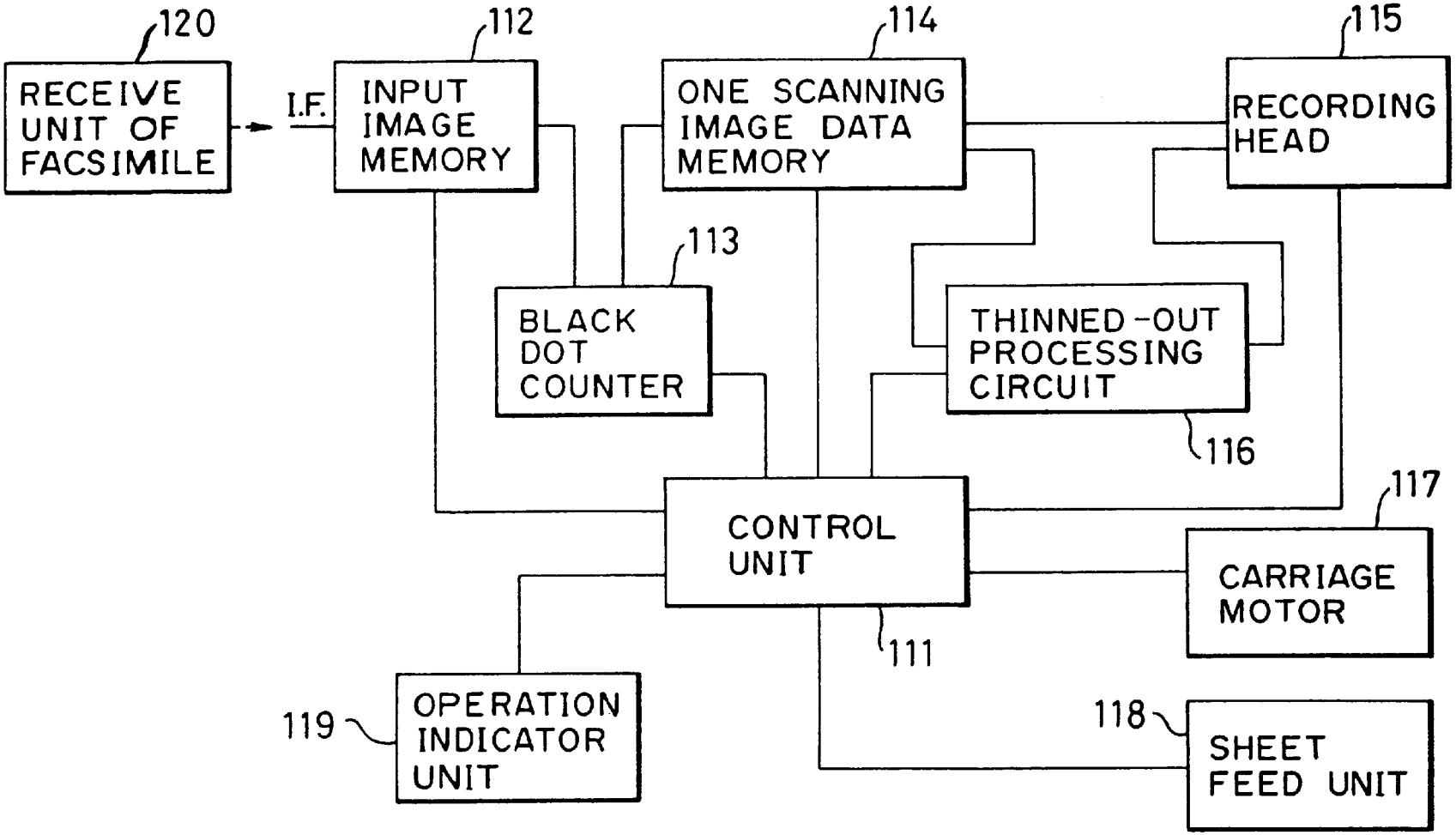
FIG. 7 is a block diagram showing the details of the control portion in the ink-jet recording apparatus in accordance with the second preferred embodiment of the present invention.

FIG. 7 is a block diagram showing an arrangement of a control portion in the recording apparatus of the second embodiment of the present invention.

Reference numeral 111 denotes a main control unit of the recording apparatus. The main control unit 111 is responsible for controlling the recording apparatus as a whole so as to perform data processing. The main control unit 111 includes ROM, RAM and CPU. In general, the CPU is connected to an ROM that stores various programs executed by the CPU, and to an RAM used as working areas (CPU, ROM and RAM are not shown in the figure). Reference numeral 112 denotes an input memory for accepting image data from a host apparatus functioning as the source of the image data. In this embodiment, the host apparatus is a receiving unit of the facsimile 120. The input memory 112 transfers the image data to a one-scanning image data memory 114 while a counter 113 counts the total number of black dots in one block of the image data. The black-dot counter 113 may be constituted by a hard circuit or performed by a software on the control unit 111. The memory for the one scanning movement of the recording head corresponds to a memory of non-coded image data (dot image data) of 48×1728 dots when the recording apparatus is provided so as to record A4 sized image with a resolution of 8 lines/mm. Reference numeral 116 denotes a thinned-out processing circuit which is responsible for removing some dots from the image data. The thinned-out process, for example make a checkered pattern, can be also performed by a software program on the control unit 111. In this case, it performs a logical multiplication (AND) every one line (48 dots) by using data of 01010101 (55H) and 10101010 (AAH) (0 means white data, 1 means black data) for every one bite of the dot image data. Using data of 00000000 (00H) for the logical multiplication every one line (48 dots), spaces are formed every one line.

There are two paths from the memory 114 to the recording head, i.e., one by which the image data is directly transferred and the other one by which the image data is transferred through the thinned-out processing circuit. These paths can be selected by the control unit 111.

Reference numeral 117 denotes a carriage motor of the recording head (corresponding to reference numeral 17 in FIG. 2). The carriage motor is responsible for moving the carriage in the main-scanning direction with transferring the data every one row to the recording head when the image data is prepared enough to perform the one scanning movement of the recording head. In this embodiment, the carriage moves in one direction simultaneously with that the recording head records the image data for the one scanning. However, it is also possible to record such data by moving the carriage back and forth.

Reference numeral 118 denotes a unit for transporting the recording medium in the direction perpendicular to moving direction of the recording head. The unit 118 is composed of a stepping motor and a motor-driver circuit which are responsible for transporting the recording medium in the sub-scanning direction step by step for each scanning movement. The transporting of the recording medium can be performed every end of the scanning movements.

Reference numeral 119 denotes a unit for indicating operating conditions of the recording apparatus. The unit 119 is composed of operation switches, means for indicating the operating conditions such as an error indicator, means for indicating the condition of the power supply such as a switch-on indicator, and the like.

Reference numeral 120 denotes a receiving unit of the facsimile which is responsible for receiving the data through a line and transporting the input data to the input image memory 112.

Figure 8:
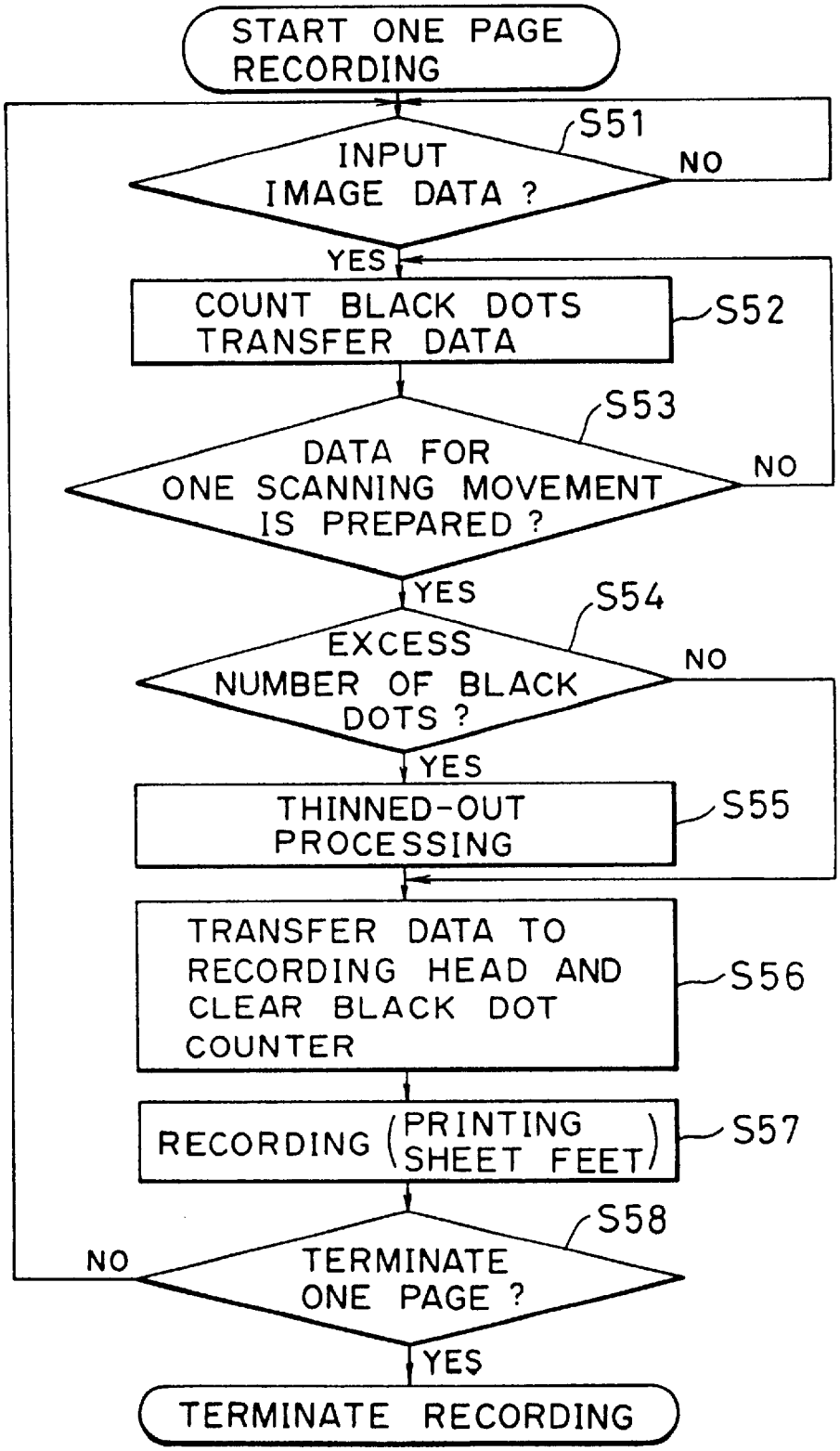
FIG. 8 is a general flow chart of the recording process controlled by the control unit of the second embodiment.

FIG. 8 is a general flow chart of a recording process controlled by the control unit 111 of the second embodiment. The recording procedure comprises the following steps:

(1) In step 51, judge whether the image data is transferred from the receiving unit 120 to the input image data memory 112 via an interface IF;

(2) In the input of the image data is satisfied in the decision step 51, step in the direction of step 52;

(3) If the input of the image data is not satisfied in the decision step 51, repeat the same step;

(4) In the step 52, count the number of the black dots in the input data and at the same time transfer the image data to one scanning image data memory 114;

(5) In the step 53, judge whether a quantity of the input data is enough to perform one scanning movement of the recording head, i.e., judge whether the one scanning image data memory 114 is filled up with the image data:

(6) If the quantity of the input data is satisfied in the decision step 53, step in direction of step 54;

(7) If the quantity of the input data is not satisfied in decision step 53, repeat the step 53;

(8) In the step 54, judge whether a percentage of the black dots is higher than the predetermined level;

(9) If the percentage of the black dots is satisfied in the decision step 54, step in the direction of step 55;

(10) If the percentage of the black dots is not satisfied in the decision step 54, step in the direction of step 56;

(11) In the step 55, thin out dots in the image data and step in the direction of step 56;

(12) In the step 56, transfer the image data to the recording head 20 and reset the black dot counter 113, and then step in the direction of step 57;

(13) In the step 57, print the image in accordance with the image data and step in the direction of step 58;

(14) In the step 58, judge whether the printing of the image data for one page is terminated;

(15) If the printing is terminated in the decision step 58, terminate the recording procedure; and

(16) If it is not terminated in decision step 9, step in the direction of the step 51 and repeat the steps from 51 to 58.

In the above described process, the memory 112 stores the image data in the form of letter codes or coded data such as MH, MR, MMR and the like, while the memory 114 stores the image data in the form of non-coded data (dot image data). In the case of the shuttle-type recording apparatus, the printing can be started after filling up the memory 114 with the input data so as to move the carriage smoothly. For example, a total quantity of dots to be printed by the recording head with 48 dots for printing an image (8 pel. A-4 size) is corresponded with one scanning data of 48×1728= 82944. Therefore, in the case of performing the thinning-out process at over 70% of black dots, step in the direction of the step 55 when the number of the black dots is 58061 or over, while step in the direction of step 56 when the number of the black dots is under 58061. In this embodiment, patterns of the thinned-out processing, a standard percentage of the black dots or the like can be defined arbitrarily.

VARIOUS ASPECTS OF THE INVENTION

The present invention can be applied to a facsimile using an ink-jet recording apparatus of piezo-type as its recording system in which piezoelectric elements are used as elements for generating ink-ejection energy. The present invention is particularly suitably usable in an ink-jet recording head having heating elements that produce thermal energy as energy used for ink ejection and recording apparatus using the head. This is because, the high density of the picture element, and the high resolution of the recording are possible.

The typical structure and the principle are preferably the one disclosed in U.S. Pat. Nos. 4,723,129 and 4,740,796.

The principle is applicable to a so-called on-demand type recording system and a continuous type recording system particularly however, it is suitable for the on-demand type because the principle is such that at least one driving signal is applied to an electrothermal transducer disposed on liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,33 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-Open No. 123670/1984 wherein a common slit is used as the ejection outlet for a plurality of electrothermal transducers, and to the structure disclosed in Japanese Patent Application Laying-Open No. 138461/1984 wherein an opening for absorbing pressure wave of the thermal energy is formed corresponding to the ejecting portion. This is because, the present invention ineffective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As a regards the kinds and the number of the recording heads mounted, a single head corresponding to a single color ink may be equipped, or plurality of heads corresponding respectively to a plurality of ink materials having different recording color or density may be equipped.

The present invention has been described in detail with respect to preferred embodiments, and it will now be that changes and modifications may be made without departing from the invention in its broader aspects, and it is the invention, therefore, in the appended claims to cover all such changes and modifications as fall within the true spirit of the invention.

What is claimed is:

1. An ink-jet recording apparatus for recording an image on a recording medium in accordance with an image data including data representing printing dots and data representing non-printing dots by a recording head having a plurality of recording elements for ejecting ink droplets in response to energy supplied by an energy source to the recording elements in accordance with the image data, wherein the recording head performs a recording operation while moved by a drive unit in a direction of main-scanning, said direction of main-scanning being substantially perpendicular to a transport direction that said recording medium is moved by a feed unit, and an image corresponded with a predetermined amount of image data is formed by performing a single main-scanning movement of the recording head in the direction of main-scanning every time a print command is generated, said apparatus comprising:

computing means for computing a number of printing dots associated with the predetermined amount of the image data corresponding to the single main-scanning movement before the predetermined amount of image data is recorded;

selecting means for selecting a first recording mode or a second recording mode to record the predetermined amount of image data, in accordance with a computed value obtained from the computing means before starting a recording of the predetermined amount of image data, and wherein when the computed value exceeds the predetermined value, the selecting means selects the second recording mode; and control means for controlling operations of the recording head to record the predetermined amount of image data in the recording mode selected by the selecting means, so that in the first recording mode, the control means allows a constant amount of energy to be supplied to the recording elements during the main-scanning movement of the recording head, and in the second mode, the control means stepwise reduces the amount of energy to be supplied to the recording elements from an initial value to a final value smaller than the initial value during the main-scanning movement of the recording head.

2. An ink-jet recording apparatus as in claim 1, wherein the selecting means selects one of the first mode and the second mode each time the predetermined amount of image data is recorded.

3. An ink-jet recording apparatus as in claim 1, further comprises moving means for relatively moving the recording head in said direction of main-scanning in order to record the predetermined amount of image data, and wherein in the second recording mode, the control means gradually reduces energy to be supplied to the recording elements in order to control driving of the recording head during a relative movement of the recording head caused by the moving means.

4. An ink-jet recording apparatus as in claim 3, wherein said direction of main-scanning differs from a direction in which the plural recording elements of the recording head are arranged.

5. An ink-jet recording apparatus as in claim 3 or claim 4, wherein the predetermined amount of image data is equal to an amount of data which can be recorded by the recording head in one recording scan resulting from the relative movement effected by the moving means.

6. An ink-jet recording apparatus as in claim 1, wherein the recording head ejects the ink droplets by using thermal energy to cause a change in state of the ink.

7. A recording apparatus according to claim 1, wherein the amount of energy in the second mode is determined based on both the computed value and a position of the recording in the main scanning movement.

8. A recording apparatus according to claim 1, wherein the amount of energy in the second mode is determined based on at least two different transfer functions that each relate the computed value to the amount of energy, each transfer function corresponding to different positions of the recording head in the main scanning movement.

9. A recording method for recording an image on a recording medium in accordance with image data by scanning a recording head including a plurality of recording elements for ejecting an ink droplet in response to energy supplied by an energy source to the recording elements in accordance with the image data, wherein an ink amount ejected by the recording head varies, depending upon the energy supplied to the recording elements, the method comprising the steps of:

a first step of providing a predetermined amount of image data representing printing dots and data representing non-printing dots;

a second step of counting printing dots associated with the predetermined amount of image data corresponding to the single scanning provided in the first step;

a third step of selecting a recording mode to record the predetermined amount of image data out of a plurality of recording modes in accordance with a counted value obtained in the second step before starting a recording of the predetermined amount of image data, wherein when the counted value does not exceed the predetermined value, a first mode is selected, and when the counted value exceeds the predetermined value, a second mode is selected; and a fourth step of recording the predetermined amount of image data on the recording medium by controlling the driving of the recording head in the recording mode selected in the third step every time a print command is generated, wherein in the first recording mode, constant energy is supplied to the recording elements during recording of the predetermined amount of image data, and in the second mode, energy which is supplied to the recording elements is reduced from an initial value to a final value smaller than the initial value during the course of recording the predetermined amount of image data.

10. A recording method as in claim 9, wherein a recording mode is selected each time the predetermined amount of image data is provided at the second step.

11. A recording method as in claim 9, wherein in the fourth step, the recording head is relatively moved with respect to the recording medium to perform recording scanning so that an image is recorded in accordance with the predetermined amount of image data, and in the second recording mode, energy to be supplied to the recording elements is gradually reduced during the relative movement.

12. A recording method as in claim 11, wherein a direction of the relative movement differs from a direction in which the plural recording elements of the recording head are arranged.

13. A recording method as in claim 11, or claim 12, wherein the predetermined amount of image data is equal to an amount of data which can be recorded by the recording head in one recording scan resulting from the relative movement.

14. A recording method as in claim 9, wherein the recording head ejects the ink droplets by using thermal energy to cause a change in state of the ink.

15. A recording apparatus according to claim 9, wherein the amount of energy in the second mode is determined based on both the computed value and a position of the recording in the main scanning movement.

16. A recording apparatus according to claim 9, wherein the amount of energy in the second mode is determined based on at least two different transfer functions that each relate the computed value to the amount of energy, each transfer function corresponding to different positions of the recording head in the main scanning movement.

* * * * *

UNITED STATES PATENT AND TRADEMARK OFFICE

CERTIFICATE OF CORRECTION

PATENT NO. : 6,238,034 B1
DATED : May 29, 2001
INVENTOR(S) : Takeshi Ono

It is certified that error appears in the above-identified patent and that said Letters Patent is hereby corrected as shown below:

Title page,
Item [56], References Cited, FOREIGN PATENT DOCUMENTS, "361553" should read -- 3-61553 --.

Column 3,
Line 13, "supplied" should read -- supplied from an energy source --; and
Lines 28 and 35, "perform" should read -- performing --.

Column 4,
Line 29, "the" should read -- there --;
Line 30, "image" should read -- an image --; and
Line 48, "the" should read -- in the --.

Column 7,
Line 3, "provided" should read -- providing --;
Line 34, "by" should read -- by a --;
Line 36, "for" should read -- for a --; and
Line 63, "be also" should read -- also be --.

Column 8,
Lines 39 and 42, "table" should read -- tables --.

Column 10,
Line 2, "to" should read to -- $t_0$ --;
Line 34, "45;" should read -- 45; and --.

Column 11,
Line 18, "make" should read -- makes -- and "be also" should read -- also be --; and
Line 65, "In" should read -- If --.

Column 13,
Line 8, "provide" should read -- provided --;
Line 23, "4,558,33" should read -- 4,558,333 --;
Line 60, "a" should be deleted; and
Line 62, "or" should read -- or a --.

UNITED STATES PATENT AND TRADEMARK OFFICE

CERTIFICATE OF CORRECTION

PATENT NO. : 6,238,034 B1
DATED : May 29, 2001
INVENTOR(S) : Takeshi Ono

It is certified that error appears in the above-identified patent and that said Letters Patent is hereby corrected as shown below:

Column 16,
Lines 31 and 35, "apparatus" should read -- method --.

Signed and Sealed this

Sixth Day of September, 2005

JON W. DUDAS
*Director of the United States Patent and Trademark Office*